US009069371B2

(12) United States Patent
Kim

(10) Patent No.: US 9,069,371 B2
(45) Date of Patent: Jun. 30, 2015

(54) HYSTERESIS GENERATING PEDAL APPARATUS

(71) Applicant: HSL Electronics Corporation, Daegu (KR)

(72) Inventor: Sun Geun Kim, Gyeonsangbuk-Do (KR)

(73) Assignee: HSL Electronics Corporation, Daegu (KR)

( * ) Notice: Subject to any disclaimer, the term of this patent is extended or adjusted under 35 U.S.C. 154(b) by 3 days.

(21) Appl. No.: 13/751,795

(22) Filed: Jan. 28, 2013

(65) Prior Publication Data

US 2014/0208886 A1 Jul. 31, 2014

(51) Int. Cl.
*G05G 1/30* (2008.04)
*G05G 5/03* (2008.04)

(52) U.S. Cl.
CPC ..... *G05G 5/03* (2013.01); *Y10T 74/20534* (2015.01)

(58) Field of Classification Search
USPC ..... 74/512, 513, 560
See application file for complete search history.

(56) References Cited

U.S. PATENT DOCUMENTS 6,658,963 B2 * 12/2003 Yaddehige ..... 74/512
8,011,270 B2 * 9/2011 Schlabach et al. ..... 74/512

* cited by examiner

*Primary Examiner* — Vicky Johnson
(74) *Attorney, Agent, or Firm* — Mintz Levin Cohn Ferris Glovsky and Popeo, P.C.; Kongsik Kim; Carolina E. Säve

(57) ABSTRACT

Provided is a hysteresis generating pedal apparatus. More specifically, the hysteresis generating pedal apparatus includes: a housing fixed to a vehicle; a pedal arm rotatably supported by the housing; and a friction member having an end supported by a spring and an other end in contact with a portion of the pedal arm and generating friction by contacting the housing when rotated by a driver's pedal effort received from the pedal arm. In particular, in a center of rotation of the friction member is different from a center of rotation of the pedal arm.

24 Claims, 13 Drawing Sheets

HYSTERESIS GENERATING PEDAL APPARATUS

BACKGROUND

1. Technical Field

The present invention relates to a pedal apparatus having hysteresis, and more particularly, to a pedal apparatus having a hysteresis structure reduces noise generated when an accelerator pedal is operated by reducing a radius of rotation of a friction member.

2. Related Art

Generally, an accelerator pedal installed in a vehicle is designed to accelerate the vehicle by adjusting the amount of air sucked in by an engine or the amount of fuel injected into the engine according to an angle at which the pedal is rotated by a force applied when a driver presses the pedal. When the driver presses or releases the accelerator pedal, a different amount of "pedal effort" is generated according to the degree to which the driver depresses the accelerator pedal. Pedal effort is the amount of force applied by a driver on a pedal at any instance in time. Then, the pedal effort is delivered to the engine via a line or a cable, thereby adjusting the speed of the vehicle. Alternatively, the pedal effort causes a sensor level coupled to the pedal to rotate when the pedal rotates, and an output value of the sensor lever is transmitted to an engine controller, which then electronically adjusts the speed of the vehicle. According to the installation position, accelerator pedals are classified into pendant-type pedals hanging from a dash panel or organ-type pedals installed on a floor panel.

An accelerator pedal is generally equipped with a hysteresis generating apparatus. The hysteresis generating apparatus can significantly reduce a driver's fatigue by controlling the pedal effort generated when the driver presses the pedal and a force applied to the driver's foot by the pedal when the driver releases the pedal to be different from each other.

FIG. 1 is a graph illustrating a hysteresis effect brought about by a frictional force generated in an accelerator pedal. Referring to FIG. 1, a line 1*a* represents an angle of rotation (or stroke) of the accelerator pedal with respect to the force acting between a driver's foot and the accelerator pedal when no friction is present.

In a hysteresis structure, when the pedal rotates, a frictional force is generated in a direction that hinders the motion of the pedal. Therefore, when the driver presses the pedal, not only a force that rotates the pedal but also a force that is larger than the frictional force are required as represented by a line 1*b*. Therefore, significant amount of pedal effort is required. On the other hand, when the driver releases the pedal, the frictional force offsets a force (e.g., an elastic force of a spring) that returns the pedal to its original position. Therefore, as represented by a line 1*c*, the force applied to the driver's foot by the pedal is reduced compared with when the frictional force is not acting. As a result, the driver feels far less fatigue when operating the accelerator pedal.

For a driver's convenience, a hysteresis generating apparatus is essentially installed in an accelerator pedal apparatus. The hysteresis generating apparatus generally includes a friction part which operates in accordance with the rotation of the pedal to produce friction. To apply the friction part, a conventional hysteresis generating apparatus is structured to use many parts. Therefore, the conventional hysteresis generating apparatus has a complicated structure. Due to the complicated structure, the conventional hysteresis generating apparatus is highly likely to break down. In addition, since a trajectory along which the friction part moves to generate a frictional force is quite significant, noise is created when the accelerator pedal apparatus operates. Furthermore, the accelerator pedal apparatus takes up a large amount of space.

SUMMARY

Aspects of the present invention provide a hysteresis generating pedal apparatus which effectively generate a frictional force using a compact member by allowing an elastic force to act directly on a friction part and reduce a movement trajectory of the friction part which moves in accordance with the rotation of a pedal.

However, aspects of the present invention are not restricted to the one set forth herein. The above and other aspects of the present invention will become more apparent to one of ordinary skill in the art to which the present invention pertains by referencing the detailed description of the present invention given below.

According to an aspect of the present invention, there is provided a hysteresis generating pedal apparatus including: a housing fixed to a vehicle; a pedal arm rotatably supported by the housing; and a friction member having an end supported by a spring and the other end in contact with a portion of the pedal arm and generating friction by contacting the housing when rotated by a driver's pedal effort received from the pedal arm, wherein a center of rotation of the friction member is different from a center of rotation of the pedal arm.

Here, a portion of the friction member which contacts the housing may be made of a different material from the housing, and/or a portion of the housing which contacts the friction member may be made of a different material from the friction member. To this end, the friction member or the housing may include a block groove formed in the portion of the friction member which contacts the housing or the portion of the housing which contacts the friction member and may further include a friction block inserted into the block groove.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

Figure 1:
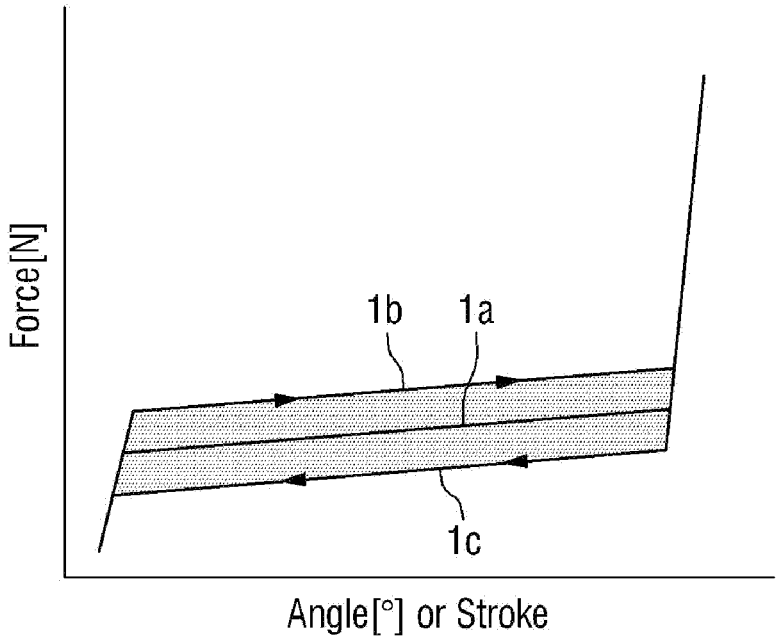
FIG. 1 is a graph illustrating a hysteresis effect.

Hereinafter, exemplary embodiments of the present invention will be described in detail with reference to the accompanying drawings. Advantages and features of the present invention and methods of accomplishing the same may be understood more readily by reference to the following detailed description of exemplary embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The configuration and operation of a hysteresis generating pedal apparatus according to an exemplary embodiment of the present invention will now be described with reference to FIGS. 2 through 5.

Figure 2:
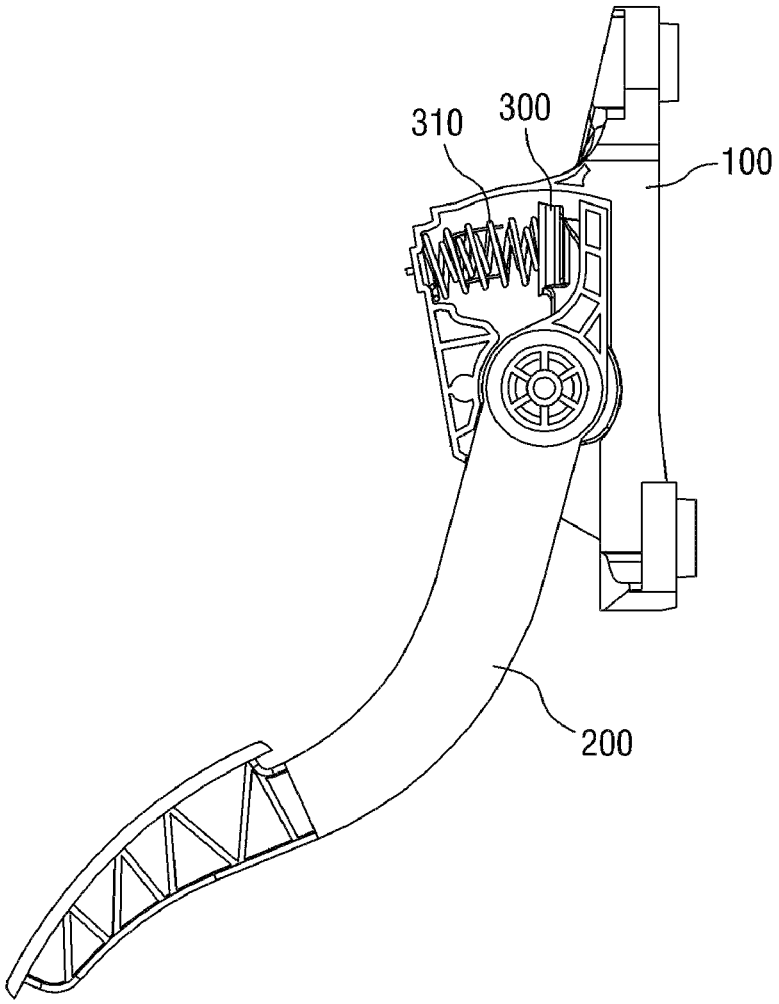
FIG. 2 is a side view of a hysteresis generating pedal apparatus according to an embodiment of the present invention.
Figure 3:
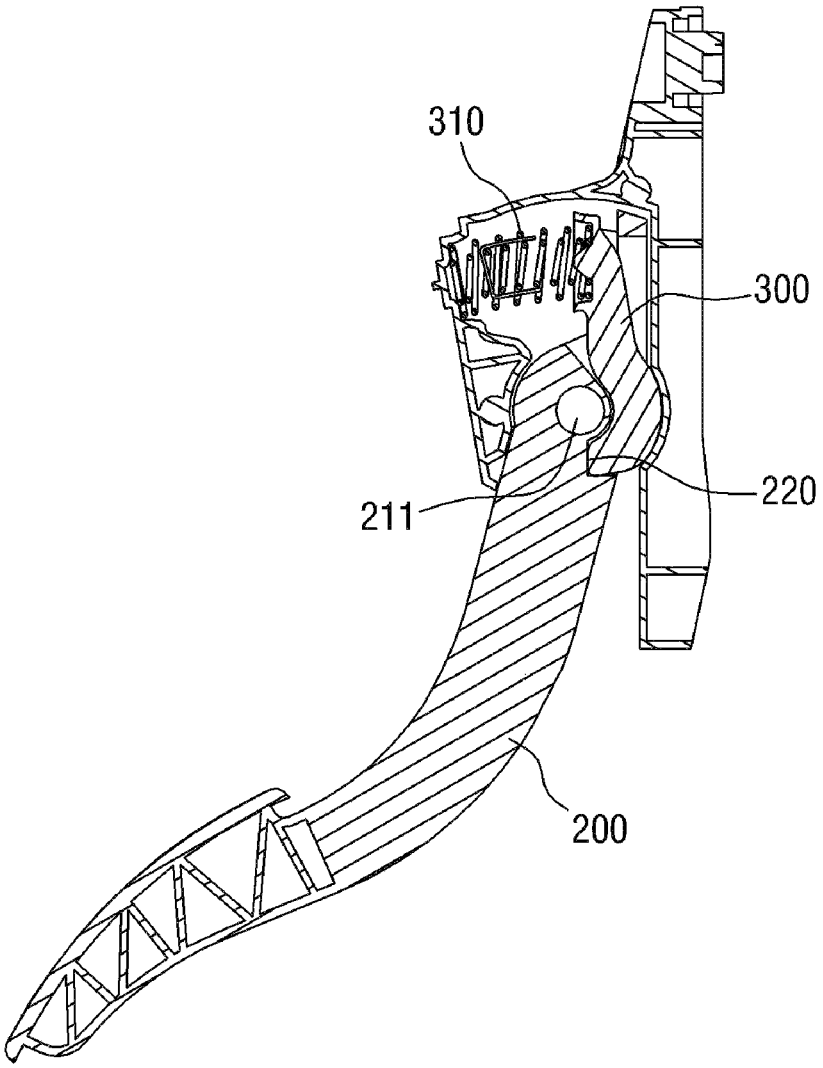
FIG. 3 is a cross-sectional view of the hysteresis generating pedal apparatus shown in FIG. 2.

FIGS. 2 and 3 are respectively a side view and a cross-sectional view of a hysteresis generating pedal apparatus according to an exemplary embodiment of the present invention. Referring to FIGS. 2 and 3, the hysteresis generating pedal apparatus according to the current exemplary embodiment includes a housing 100, a pedal arm 200, and a friction member 300.

The housing 100 is fixed to a vehicle at a position at which the hysteresis generating pedal apparatus according to the current embodiment is installed. The housing 100 supports and covers elements (including the pedal arm 200 and the friction member 300) of the current embodiment. In particular, the pedal arm 200 is rotatably supported by the housing 100. To this end, the housing 100 may include a spindle 210 inserted into the position of a center of rotation 211 of the pedal arm 200. In addition, an end of a spring 310 may be connected to a portion of the housing 100 in order to constantly apply an elastic force to the pedal arm 200 via the friction member 300. The housing 100 may further include a sensor lever configured to sense the rotation of the pedal arm 200 and transmit an output value (i.e., the sensed rotation) to an engine controller.

The pedal arm 200 is rotatably supported by the housing 100. To this end, the pedal arm 200 may include the spindle 210 fixed to the position of the center of rotation 211, and the spindle 210 may be coupled to the housing 100. Alternatively, if the spindle 210 is included in the housing 100, the spindle 210 fixed to the housing 100 may be coupled to the center of rotation 211 of the pedal arm 200 such that the housing 100 can rotatably support the pedal arm 200.

An end of the friction member 300 is supported by the spring 310. The spring 310, by its elastic nature, always applies a pushing force to the friction member 300. If the pedal arm 200, not the friction member 300, is supported by the spring 310 and if the friction member 300 operates in accordance with the operation of the pedal arm 200, an elastic force of the spring 310 is delivered to the friction member 300 via the pedal arm 200. The force applied to the friction member 300 by the spring 310 may be divided into a force that rotates the pedal arm 200 to its original position and a force that rotates the friction part itself. If the spring 310 directly supports the pedal arm 200, the former force is greater. On the other hand, in the current exemplary embodiment, the spring 310 directly supports the friction member 300, not the pedal arm 200. Therefore, the elastic force of the spring 310 is delivered directly to the friction member 300. Accordingly, the latter force is greater. In this case, even if the elastic force of the spring 310 remains unchanged, the friction member 300 receives a greater force. As a result, this increases a frictional force created on a friction surface between the friction member 300 and the housing 100 in contact, thereby generating a hysteresis effect more efficiently.

An end of the friction member 300 is supported by the spring 310 as described above, and the other end of the friction member 300 is interposed between the pedal arm 200 and the housing 100 to contact a portion of the pedal arm 200. Since the other end of the friction member 300 contacts the pedal arm 200, the pedal arm 200 delivers a driver's pedal effort to the friction member 300, and the pedal effort rotates the friction member 300. Here, a center of rotation 320 of the friction member 300 is different from the center of rotation 211 of the pedal arm 200.

Referring to the cross-sectional view of FIG. 3, a portion of the friction member 300 included in the hysteresis generating pedal apparatus may be shaped like a ring, such that the friction member 300 can be rotated by the pedal effort delivered through the pedal arm 200. The other end of the friction member 300 which is not connected to the spring 310 contacts the pedal arm 200 to receive the pedal effort from the pedal arm 200. In addition, an outer surface of the ring of the friction member 300 contacts the housing 100, thus creating friction.

According to the current exemplary embodiment of the present invention, the friction member 300 and the pedal arm 200 are coupled to each other due to their relative positions and shapes. Except for these reasons, the friction member 300 and the pedal arm 200 are not mechanically coupled to each other. As a result, the friction member 300 is freely rotated and moved by the pedal effort from the pedal arm 200 and the elastic force of the spring 310, which respectively act on both ends of the friction member 300, and a force from the friction surface between the friction member 300 and the housing 100 in contact.

The pedal arm 200 may include a coupling groove 220 formed adjacent to the center of rotation 211 of the pedal arm 200, and the friction member 300 may be inserted into the coupling groove 220. If the friction member 300 is inserted into the coupling groove 220 formed in the pedal arm 200, the pedal arm 200 and the friction member 300 can be coupled to each other more securely without requiring other mechanical couplings. As a result, the pedal effort from the pedal arm 200 is delivered more effectively to the friction member 300.

Figure 4:
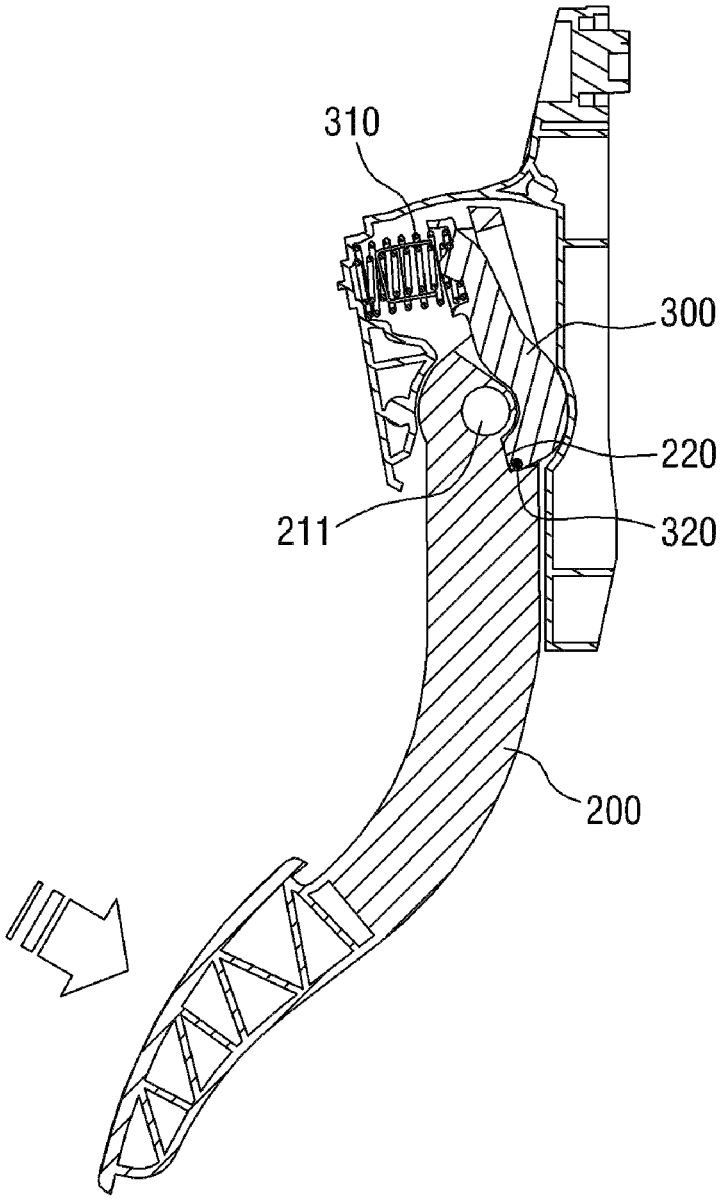
FIG. 4 is a cross-sectional view showing the operation of the hysteresis generating pedal apparatus of FIG. 2.
Figure 5:
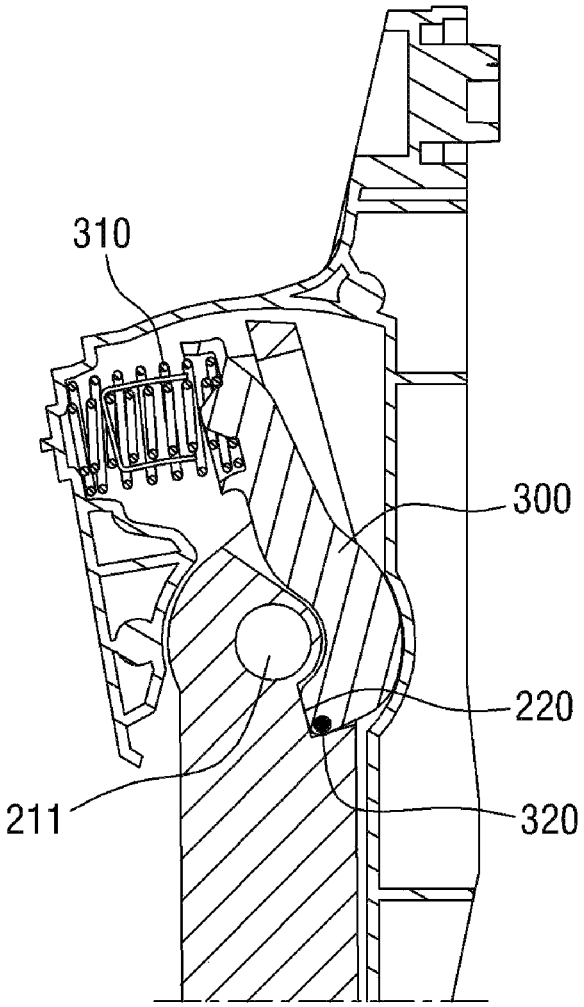
FIG. 5 is an enlarged cross-sectional view showing the operation of a friction member according to the embodiment of FIG. 4.

FIG. 4 is a diagram showing the overall operation of the hysteresis generating pedal apparatus of FIGS. 2 and 3 when a driver presses the pedal. FIG. 5 is an enlarged diagram showing the operation of the friction member 300 when the hysteresis generating pedal apparatus of FIGS. 2 and 3 operates as in FIG. 4.

Referring to FIG. 4, when a driver presses a pedal pad at an end of the pedal arm 200 to accelerate, the pedal arm 200 rotates in a counterclockwise direction. Here, since an end of the friction member 300 is coupled to the pedal arm 200, the pedal arm 200, as it rotates, applies a force to the end of the friction member 300, and the applied force rotates the friction member 300 in the counterclockwise direction. As described above, the friction member 300 is configured to be freely moved by the force exerted by the rotation of the pedal arm 200 and the elastic force of the spring 310. Therefore, as the friction member 300 is pushed upward by the rotary motion of the pedal arm 200, it rotates. As a result, the interaction between the rectilinear motion and rotary motion of the friction member 300 causes the center of rotation 320 of the friction member 300 to be formed not at the center of rotation 211 of the pedal arm 200 but at the end of the friction member 300 which is coupled to the pedal arm 200.

Since the friction member 300 rotates about the center of rotation 320 which is different from the center of rotation 211 of the pedal arm 200, it rotates in accordance with the rotation of the pedal arm 200 but at a smaller angle than an angle of rotation of the pedal arm 200. As a result, even if the pedal arm 200 is rotated by the same angle, a movement trajectory of the friction member 300 is reduced. If the movement trajectory of the friction member 300 is large, noise can be created when the accelerator pedal is operated. However, the hysteresis generating pedal apparatus of the present invention can reduce noise while efficiently generating a hysteresis effect.

The center of rotation 320 of the friction member and a contact surface (i.e., the friction surface) between the friction member 300 and the housing 100 may be located on a circumference of a circle having the center of rotation 211 of the pedal arm 200 as its center. In this case, since the individual rotary motion of the friction member 300 is conducted more efficiently in accordance with the rotary motion of the pedal arm 200, the rotation of the pedal arm 200 may cause the friction member 300 to rotate more smoothly.

The configuration of a hysteresis generating pedal apparatus according to another exemplary embodiment of the present invention will now be described with reference to FIGS. 6 through 8.

Figure 6:
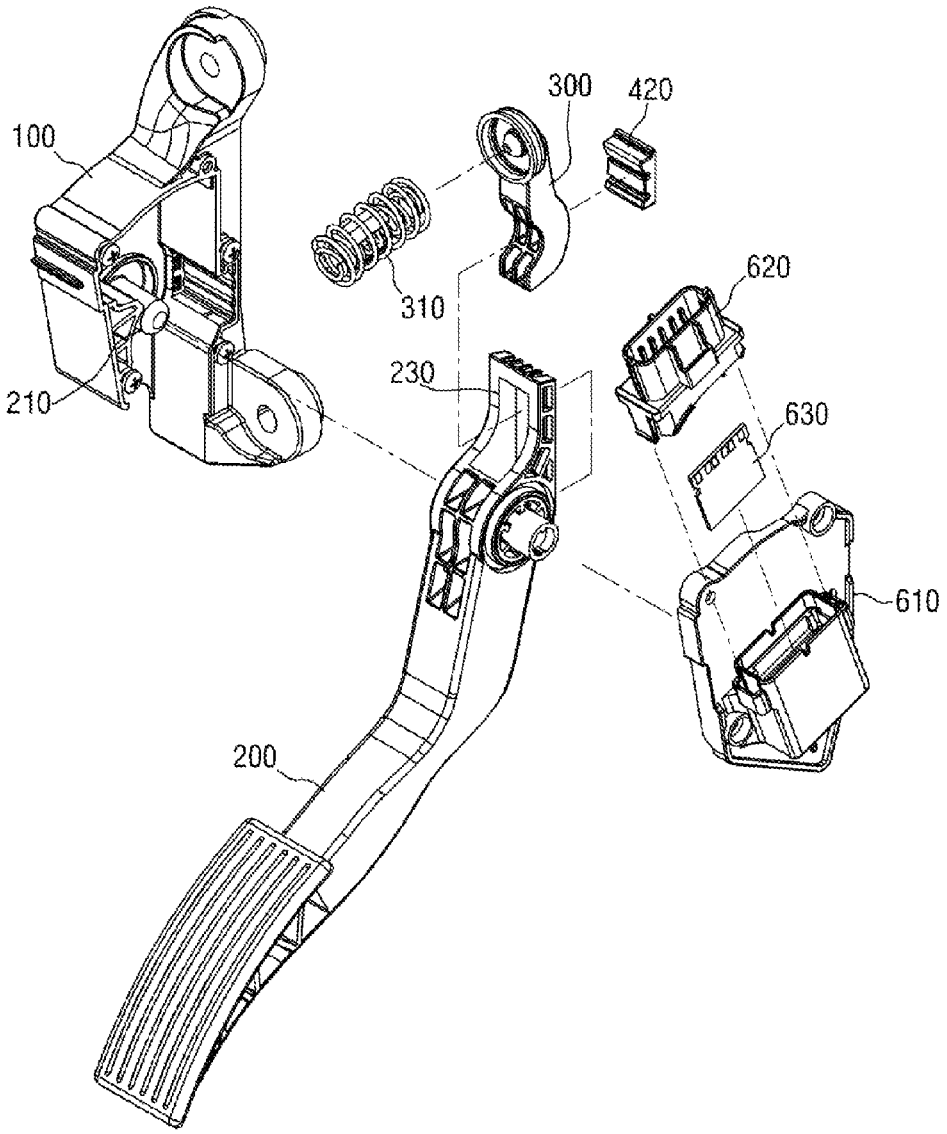
FIG. 6 is an exploded perspective view of a hysteresis generating pedal apparatus according to another embodiment of the present invention.

FIG. 6 is an exploded perspective view of a hysteresis generating pedal apparatus according to another exemplary embodiment of the present invention. In FIG. 6, a housing 100, a pedal arm 200, a friction member 300, a spring 310, a cover 610, a connecting housing 620, a printed circuit board (PCB) substrate 630, and a friction block 420 are illustrated. The cover 610 covers the pedal arm 200 and is coupled to the housing 100 in order to fix and protect the pedal arm 200 inside the housing 100 in a state where the pedal arm 200 is coupled to the housing 100 by a spindle 210. An aperture may be formed in a top surface of the cover 610 at and around a position opposite the spindle 210 of the pedal arm 200, and the PCB substrate 630 may be mounted in the aperture.

In the current exemplary embodiment of the present invention, a magnet (not shown) may be provided at an end of the spindle 210 of the pedal arm 200. The PCB substrate 630 may be located above the magnet and may sense an angle of rotation of the pedal arm 200, and may transmit information about the sensed angle of rotation to an engine controller. The connecting housing 620 is coupled to the aperture of the cover 610 in order to provide a connecting aperture for a cable that can supply power to the PCB substrate 630 or transmit information sensed by the PCB substrate 630 to the controller.

According to the current exemplary embodiment of the present invention, the pedal arm 200 included in the present invention may include not only a coupling groove 220 which is formed adjacent to a center of rotation 211 of the pedal arm 200 and into which the friction member 300 is inserted but also an aperture 230 which is formed above the center of rotation 211 to penetrate the pedal arm 200 and is connected to the coupling groove 220. Here, the friction member 300 passes through the aperture 230 and is inserted into the coupling groove 220. As shown in FIG. 6, an end of the friction member 300 enters into a frame formed in an upper part of the pedal arm 200 and then inserted into the coupling groove 220 formed in a rear surface of the pedal arm 200. As a result, the friction member 300 is coupled to the pedal arm 200.

Referring to FIG. 6, when the pedal arm 200 and the friction member 300 are coupled to each other, a portion of a circumference of the aperture 230 may be located behind an end of the friction member 300 which is connected to the spring 310. Therefore, when the pedal arm 200 rotates, the portion of the circumference of the aperture 230 may cause the friction member 300 to rotate in accordance with the rotation of the pedal arm 200. That is, when the pedal arm 200 rotates, the coupling groove 220 may apply a force to an end of the friction member 300 while the portion of the circumference of the aperture 230 contacts the other end of the friction member 300 and applies a force to the other end of the friction member 300. As a result, the friction member 300 can operate more smoothly in accordance with the operation of the pedal arm 200.

According to the current exemplary embodiment, a portion of the friction member 300 which contacts the housing 100 may be made of a different material from the housing 100, and/or a portion of the housing 100 which contacts the friction member 300 may be made of a different material from the friction member 300. To control the magnitude of a frictional force generated by a friction surface between the friction member 300 and the housing 100 in contact, the different material may have an appropriate coefficient of friction according to a desired level of hysteresis.

Here, the material may be polyoxymethylene (POM). POM is gaining popularity as resin that can replace metal and has superior mechanical properties (such as fatigue resistance, toughness, and wear resistance) that cannot be found in other plastic materials. The mechanical properties of POM are superior both at high and low temperatures. In addition, POM shows similar stress-strain responses to metal and has good elastic recovery. Due to these advantages, POM can be used in place of metal. In particular, POM is excellent in creep resistance, fatigue resistance, and wear resistance. Typically, POM has better mechanical properties than plastic that forms the housing 100 and has a greater coefficient of friction than metal that forms the pedal arm 200. Therefore, if the friction surface between the housing 100 and the pedal arm 200 in contact is made of POM, the durability of the friction surface can be increased, while the hysteresis effect is increased.

Figure 7:
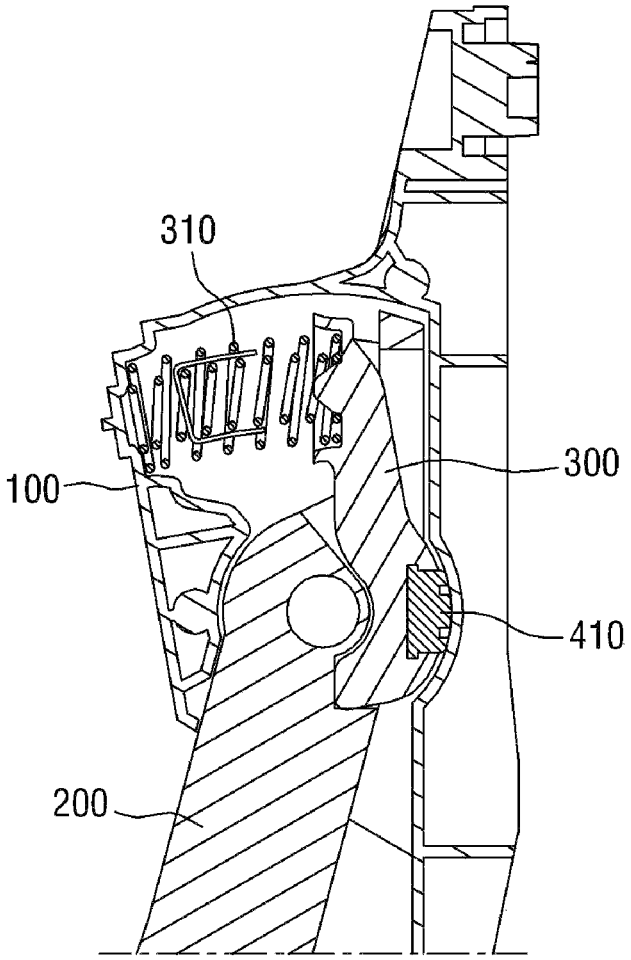
FIGS. 7 and 8 respectively are enlarged cross-sectional views of hysteresis generating pedal apparatuses according to other embodiments of the present invention.
Figure 8:
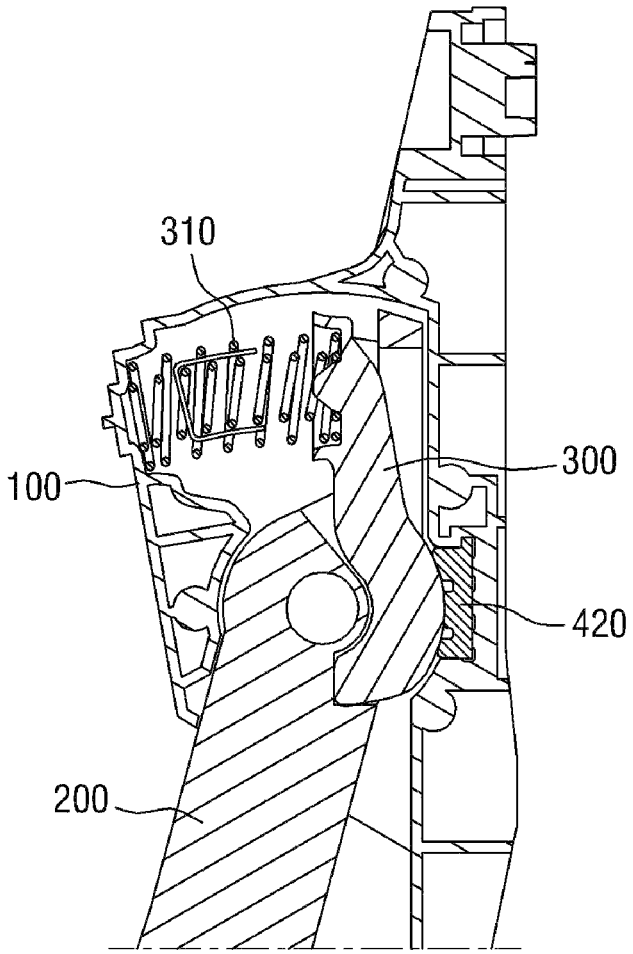

FIGS. 7 and 8 respectively show hysteresis generating pedal apparatuses, each further including a friction member 410 or 420 inserted into the friction member 300 or the housing 100 such that a portion of the friction member 300 which contacts the housing 100 and a portion of the housing 100 which contacts the friction member 300 are made of different materials.

Referring to FIGS. 7 and 8, to generate a certain frictional force at a contact surface between the friction member 300 and the housing 100, a different material may be used for a portion of the friction member 300 or the housing 100 which contacts the housing 100 or the friction member 300. To this end, the friction block 410 or 420 may further be inserted into the friction member 300 or the housing 100. Referring to FIG. 7, if the friction block 410 is to be inserted into the friction member 300, a block groove may be formed in a portion of the friction member 300 which contacts the housing 100, and the friction block 410 may be inserted into the block groove. Alternatively, referring to FIG. 8, if the friction block 420 is to be inserted into the housing 100, a block groove may be formed in a portion of the housing 100 which contacts the friction member 300, and the friction block 420 may be inserted into the block groove. Here, an outer surface of the friction block 410 or 420 may be formed to have the same curvature as the curvature of the friction member 300 or the housing 100 around the outer surface. The exemplary embodiment in which a block groove is formed in the housing 100 and the friction block 420 is inserted into the block groove is shown in the exploded perspective view of FIG. 6.

The friction blocks 410 and 420 can be made of any material that has a coefficient of friction for generating an appropriate frictional force. However, the friction blocks 410 and 420 may preferably be made of POM that can generate an appropriate frictional force and cause the friction member 300 to rotate smoothly. In addition, each of the friction blocks 410 and 420 inserted into the block grooves may protrude from the friction member 300 or the housing 100. In this case, a protruding portion of the friction block 410 or 420 may cause the friction member 300 and the housing 100 to come in contact more closely, thereby generating a frictional force more effectively.

The above exemplary embodiments of the present invention have been described using a pendent-type pedal apparatus as an example. However, the present invention is not limited to the pendant-type pedal apparatus and can also be applied to an organ-type pedal apparatus. The organ-type pedal apparatus will hereinafter be described.

Figure 9:
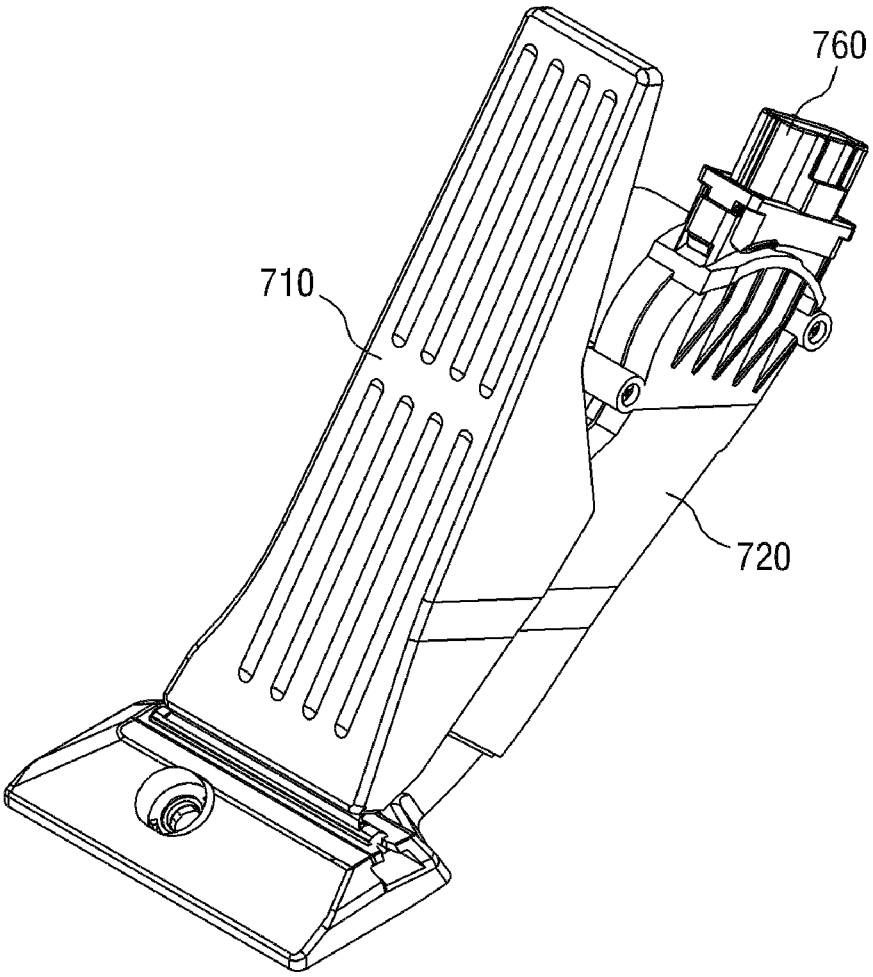
FIG. 9 is a perspective view of a hysteresis generating pedal apparatus according to another embodiment of the present invention.
Figure 10:
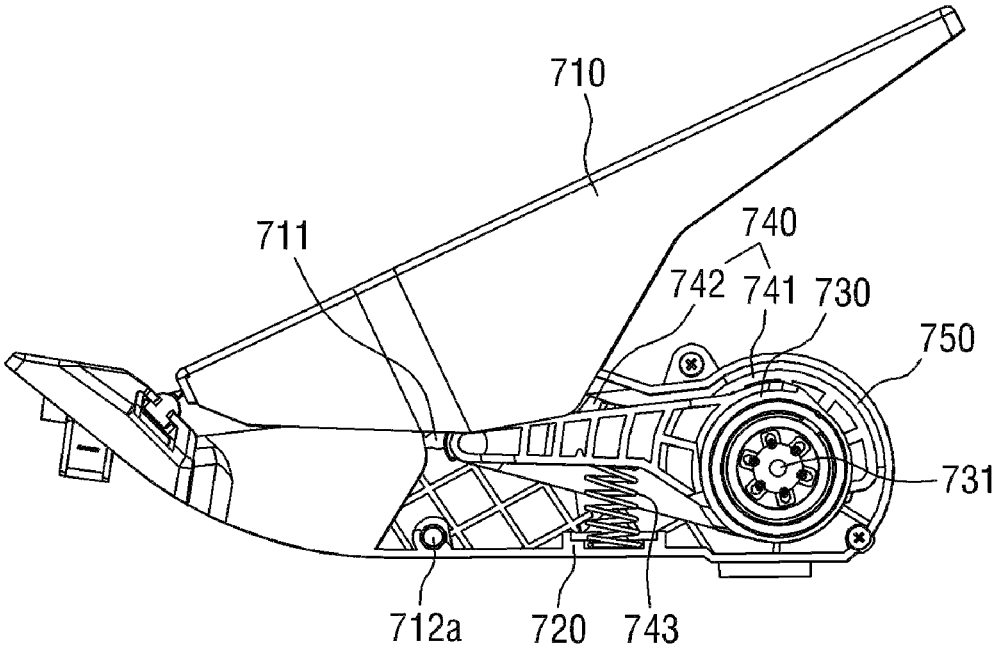
FIG. 10 is an internal view of the hysteresis generating pedal apparatus shown in FIG. 9.
Figure 11:
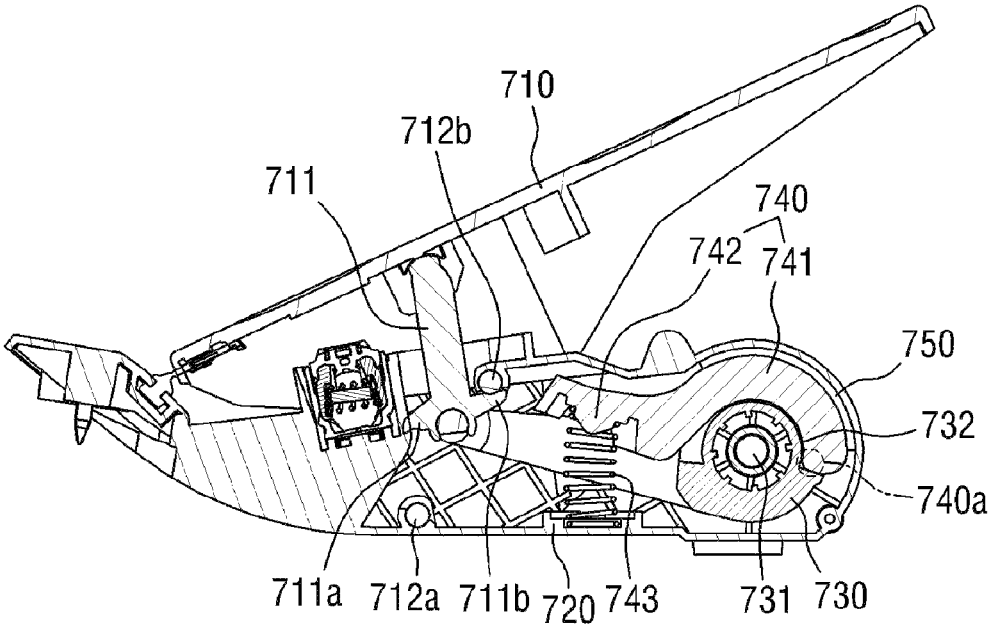
FIG. 11 is a cross-sectional view of the hysteresis generating pedal apparatus shown in FIG. 9.

FIG. 9 is a perspective view of a hysteresis generating pedal apparatus according to another exemplary embodiment of the present invention. FIG. 10 is an internal view of the hysteresis generating pedal apparatus shown in FIG. 9. FIG. 11 is a cross-sectional view of the hysteresis generating pedal apparatus shown in FIG. 9. FIGS. 9 through 11 show an example of the organic-type pedal apparatus.

Referring to FIGS. 9 through 11, the hysteresis generating pedal apparatus according to the current exemplary embodiment may include a pedal pad 710, a housing 720, a pedal arm 730, a friction member 740, and a friction block 750. The housing 720 may be fixed to a floor panel under a driver's seat, and the pedal pad 710 may be hinge-coupled to the housing 720 such that it can be rotated vertically by the driver's pedal effort.

The pedal arm 730 is installed to rotate about a spindle 731 inside the housing 720. An end of the pedal arm 730 may be connected to an end of a carrier 711 which extends in an outer circumferential direction of the spindle 731 and penetrates the housing 720. The other end of the carrier 711 may be connected to the pedal pad 710. Therefore, when the driver presses the pedal pad 710, thereby rotating the pedal pad 710 vertically, the pedal arm 710 may also rotate about the spindle 731. A plurality of protrusions 711*a* and 711*b* may be formed at the end of the carrier 711 which is connected to the end of the pedal arm 730. When the carrier 711 is moved by the rotation of the pedal pad 710, the protrusions 711*a* and 711*b* get caught on a plurality of movement-limiting protrusions 712*a* and 712*b* which are formed in a movement direction of the carrier 711 to limit a movement range of the carrier 711. Therefore, the carrier 711 is prevented from moving beyond an appropriate movement range.

Figure 12:
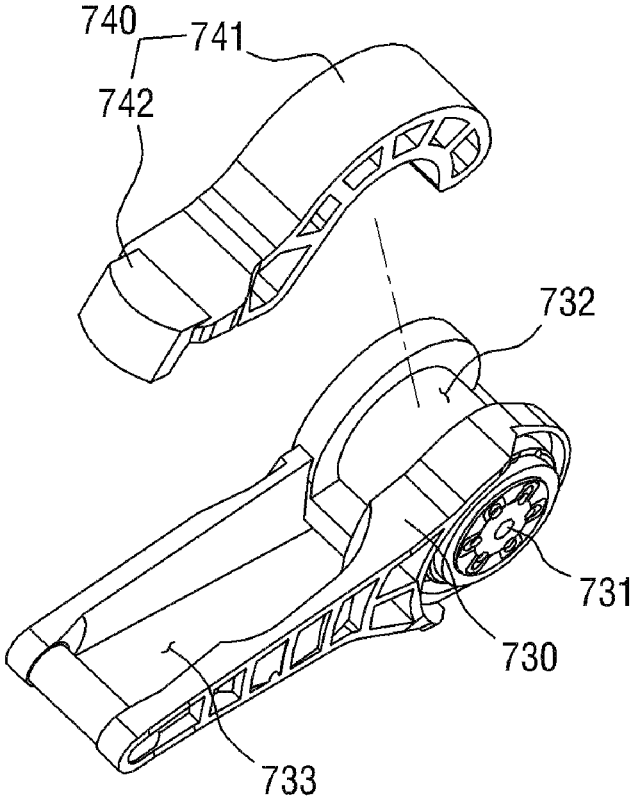
FIG. 12 is a perspective view of a pedal arm and a friction member included in the hysteresis generating pedal apparatus of FIG. 9.

Referring to FIG. 12, the friction member 740 may include an insertion portion 741 and an extension portion 742. The insertion portion 741 is inserted into an insertion groove 732 formed along an outer circumference of an end of the pedal arm 730 which is adjacent to the spindle 731 of the pedal arm 730, and the extension portion 742 extends from a side of the insertion portion 741. The extension portion 742 is connected to an end of the spring 743 supported by the housing 720. Thus, the extension portion 742 is constantly provided with an elastic force.

Here, an end of the insertion portion 741 inserted into the insertion groove 732 (for example, an end of the insertion portion 741 which is opposite the extension portion 742) gets caught on an end of the insertion groove 732. Therefore, when the pedal arm 730 rotates about the spindle 731 in a direction, the friction member 740 also rotates. That is, the friction member 740 may receive the pedal effort from the pedal arm 730 through the insertion portion 741 inserted into the insertion groove 732.

For example, when the driver presses the pedal pad 710, the carrier 711 may move downward of FIGS. 10 and 11, thereby rotating the pedal arm 730 in a counterclockwise direction. In this case, since an end of the insertion portion 741 is caught on an end of the insertion groove 732, the friction member 740 may also rotate. On the other hand, when the driver releases the pedal pad 710, the friction member 740 may be returned to its original position by the elastic force of the spring 743. Accordingly, the pedal arm 730 may return to its original position.

An aperture 733 may be formed between a position on the pedal arm 730 which is near the spindle 731 of the pedal arm 730 and an end of the pedal arm 730 which is connected to the carrier 711. An end of the extension portion 742 of the friction member 740 may be connected to an end of the spring 743 through the aperture 733.

As in the above-described exemplary embodiments, in the current exemplary embodiment, the friction member 740 is configured to be freely moved by a force exerted by the rotation of the pedal arm 730 and the elastic force of the spring 743. Therefore, as the friction member 740 is pushed sideward by the rotary motion of the pedal arm 730, it rotates. As a result, a center of rotation 740*a* of the friction member 740 may be formed not at a center of rotation of the pedal arm 730 but at an end of the friction member 740 which is coupled to the pedal arm 730.

Unlike the above-described exemplary embodiments, in the current exemplary embodiment, the friction member 740 is pushed sideward, not upward. However, this is due to the position of the pedal arm 730 or the friction member 740. The direction in which the friction member 740 is pushed can vary.

As in the above-described exemplary embodiments, in the current exemplary embodiment, the center of rotation (corresponding to the spindle 731) of the pedal arm 730 is different from the center of rotation 740*a* of the friction member 740. Therefore, the friction member 740 may rotate at a smaller angle than an angle of rotation of the pedal arm 730. As a result, a movement trajectory of the friction member 740 may be reduced, which, in turn, reduces noise generated when the accelerator pedal is operated.

The friction block 750 may be formed in the housing 720 which contacts the insertion portion 741. The friction block 750 may contact the insertion portion 741, thus producing friction. As in the above-described embodiments, the friction block 750 is designed to make a portion of the friction member 740 which contacts the housing 720 and a portion of the housing 720 which contacts the friction member 740 be formed of different materials. To control the magnitude of a frictional force generated by a friction surface between the friction member 740 and the housing 720 in contact, the friction block 750 may be made of a material that can have an appropriate coefficient of friction according to a desired level of hysteresis.

In the current embodiment of the present invention, a case where the friction block 750 is formed on a surface of the insertion portion 741 which contacts the housing 720 has been described. However, this is merely an example used to help understand the present invention, and the present invention is not limited to this example. One or more friction blocks 750 having the same or different coefficients of friction can be formed on one or more of the insertion portion 741 and the housing 720. When necessary, the friction block 750 can be omitted. If the friction block 750 is omitted, the friction member 740 may directly contact the housing 720, thus generating friction.

The friction block 750 may be inserted into a block groove formed in at least one of the insertion portion 741 and the housing 720, and at least a portion of the friction block 750 may protrude from the insertion portion 741 or the housing 720.

Figure 13:
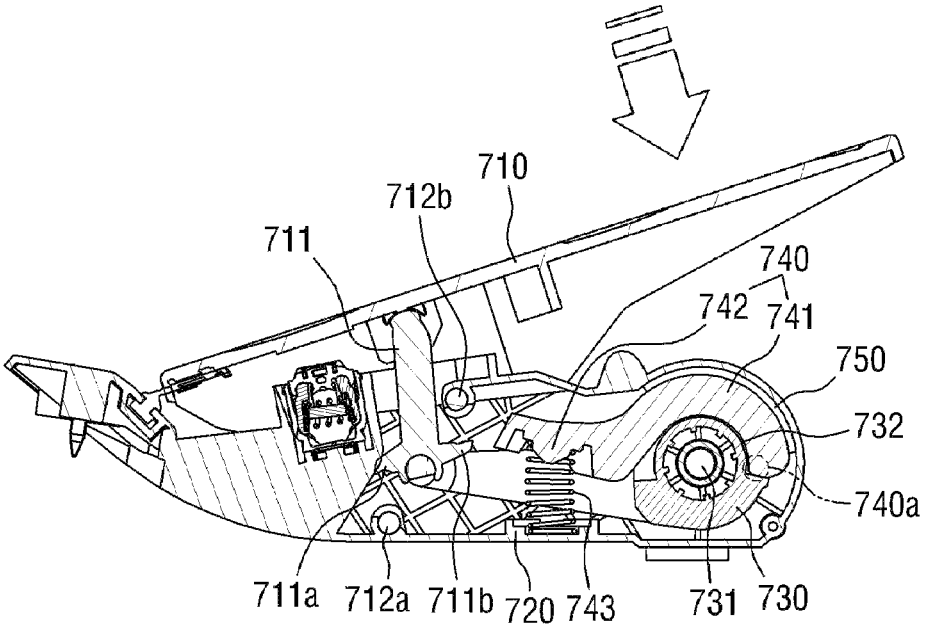
FIG. 13 is a cross-sectional view showing the operation of the hysteresis generating pedal apparatus of FIG. 9.

In the operation of the above-described hysteresis generating pedal apparatus according to the current embodiment, when the driver presses the pedal pad 710 in the state of FIG. 10, the pedal pad 710 rotates downward as shown in FIG. 13, and the carrier 711 connected to the pedal pad 710 moves downward. Consequently, the pedal arm 730 rotates about the spindle 731. Here, the insertion portion 741 of the friction member 740 which is inserted into the insertion groove 732 of the pedal arm 730 also rotates while generating friction.

When the driver presses the pedal pad 710, a force which overcomes a frictional force generated between the insertion portion 741 and the friction block 750 and the elastic force of the spring 743 is required. Therefore, great pedal effort is required. On the other hand, when the driver releases the pedal pad 710, a force applied to the driver's foot by the elastic force of the spring 760 becomes relatively small. Therefore, the driver's fatigue can be significantly reduced.

The hysteresis generating pedal apparatus according to the current embodiment may include a connector 760 which transmits information about the angle of rotation and operation of the pedal arm 730 to an engine controller.

The above embodiments of the present invention have been described using the pendent-type pedal apparatus and the organic-type pedal apparatus as examples. However, the present invention is not limited to the pendant-type pedal apparatus and the organ-type pedal apparatus. The present invention can also be applied to various types of pedal apparatuses which can generate a hysteresis effect using the friction members according to the above embodiments of the present invention.

According to the exemplary embodiment of the present invention, a spring connected to a housing is directly connected to a friction member. Therefore, an elastic force of the spring acts directly on the friction member, not on a pedal arm. This increases a force that presses the friction member, thereby generating a great frictional force. As a result, a hysteresis effect can be obtained efficiently. In addition, since a center of rotation of the friction member is located close to a friction surface, a movement trajectory of the friction member is reduced. The reduced movement trajectory of the friction member can reduce noise generated when a pedal operates. Furthermore, ease of assembly can be significantly improved by simplifying parts of a hysteresis generating apparatus included in an accelerator pedal. This can also lead to an increase in productivity and a reduction in weight and size.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A hysteresis generating pedal apparatus comprising:
- a housing fixed to a vehicle;
- a pedal arm rotatably supported by the housing; and
- a friction member having an end supported by a spring and an other end in contact with a portion of the pedal arm and generating friction by contacting the housing when rotated due to pedal effort received from the pedal arm,
- wherein a center of rotation of the friction member is different from a center of rotation of the pedal arm, and
- wherein a portion of the friction member which contacts the housing is made of a different material than the housing, and/or a portion of the housing which contacts the friction member is made of a different material than the friction member.

2. The hysteresis generating pedal apparatus of claim 1, wherein the pedal arm comprises a coupling groove formed adjacent to the center of rotation of the pedal arm, and the friction member is inserted into the coupling groove.

3. The hysteresis generating pedal apparatus of claim 2, wherein the pedal arm comprises an aperture which is formed above the center of rotation of the pedal arm to penetrate the pedal arm and is connected to the coupling groove, and the friction member passes through the aperture and is inserted into the coupling groove.

4. The hysteresis generating pedal apparatus of claim 1, wherein the friction member comprises:
- an insertion portion inserted into an insertion groove formed along an outer circumference of an end of the pedal arm which is adjacent to a spindle of the pedal arm; and
- a extension portion extending from a side of the insertion portion,
- wherein an end of the extension portion is connected to an end of the spring which is supported by the housing.

5. The hysteresis generating pedal apparatus of claim 4, wherein the end of the extension portion is connected to the spring through an aperture which is formed between a position on the pedal arm which is near the spindle of the pedal arm and an end of the pedal arm which extends in an outer circumferential direction of the spindle of the pedal arm.

6. The hysteresis generating pedal apparatus of claim 4, wherein the friction member generates the friction when the insertion portion contacts a portion of the housing which is adjacent to the insertion portion.

7. The hysteresis generating pedal apparatus of claim 1, wherein the center of rotation of the friction member and a contact surface between the friction member and the housing are located on a circumference of a circle having the center of rotation of the pedal arm as a center thereof.

8. The hysteresis generating pedal apparatus of claim 1, wherein at least one of the portion of the friction member which contacts the housing and the portion of the housing which contacts the friction member is made of polyoxymethylene (POM).

9. The hysteresis generating pedal apparatus of claim 1, wherein the friction member or the housing comprises a block groove formed in the portion of the friction member which contacts the housing or the portion of the housing which contacts the friction member and further comprises a friction block inserted into the block groove.

10. The hysteresis generating pedal apparatus of claim 9, wherein the friction block is made of POM.

11. The hysteresis generating pedal apparatus of claim 9, wherein the friction block is inserted into the block groove and protrudes from the friction member or the housing.

12. The hysteresis generating pedal apparatus of claim 1, wherein the spring connected to a housing is directly connected to the friction member to support the friction member and not the pedal arm.

13. A hysteresis generating pedal apparatus comprising:

a housing fixed to a vehicle;

a pedal arm rotatably supported by the housing; and a friction member having an end supported by a spring and an other end in contact with a portion of the pedal arm and generating friction by contacting the housing when rotated due to pedal effort received from the pedal arm, wherein a center of rotation of the friction member is different from a center of rotation of the pedal arm, and wherein the center of rotation of the friction member and a contact surface between the friction member and the housing are located on a circumference of a circle having the center of rotation of the pedal arm as a center thereof.

14. The hysteresis generating pedal apparatus of claim 13, wherein the pedal arm comprises a coupling groove formed adjacent to the center of rotation of the pedal arm, and the friction member is inserted into the coupling groove.

15. The hysteresis generating pedal apparatus of claim 14, wherein the pedal arm comprises an aperture which is formed above the center of rotation of the pedal arm to penetrate the pedal arm and is connected to the coupling groove, and the friction member passes through the aperture and is inserted into the coupling groove.

16. The hysteresis generating pedal apparatus of claim 13, wherein the friction member comprises:

an insertion portion inserted into an insertion groove formed along an outer circumference of an end of the pedal arm which is adjacent to a spindle of the pedal arm; and a extension portion extending from a side of the insertion portion, wherein an end of the extension portion is connected to an end of the spring which is supported by the housing.

17. The hysteresis generating pedal apparatus of claim 16, wherein the end of the extension portion is connected to the spring through an aperture which is formed between a position on the pedal arm which is near the spindle of the pedal arm and an end of the pedal arm which extends in an outer circumferential direction of the spindle of the pedal arm.

18. The hysteresis generating pedal apparatus of claim 16, wherein the friction member generates the friction when the insertion portion contacts a portion of the housing which is adjacent to the insertion portion.

19. The hysteresis generating pedal apparatus of claim 13, wherein a portion of the friction member which contacts the housing is made of a different material than the housing, and/or a portion of the housing which contacts the friction member is made of a different material than the friction member.

20. The hysteresis generating pedal apparatus of claim 19, wherein at least one of the portion of the friction member which contacts the housing and the portion of the housing which contacts the friction member is made of polyoxymethylene (POM).

21. The hysteresis generating pedal apparatus of claim 19, wherein the friction member or the housing comprises a block groove formed in the portion of the friction member which contacts the housing or the portion of the housing which contacts the friction member and further comprises a friction block inserted into the block groove.

22. The hysteresis generating pedal apparatus of claim 21, wherein the friction block is made of POM.

23. The hysteresis generating pedal apparatus of claim 21, wherein the friction block is inserted into the block groove and protrudes from the friction member or the housing.

24. The hysteresis generating pedal apparatus of claim 13, wherein the spring connected to a housing is directly connected to the friction member to support the friction member and not the pedal arm.

* * * * *